US006349771B1

(12) United States Patent
Luke

(10) Patent No.: US 6,349,771 B1
(45) Date of Patent: Feb. 26, 2002

(54) FLOW ACTUATED SHUT-OFF VALVE

(75) Inventor: Mike A. Luke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/459,684

(22) Filed: Dec. 13, 1999

(51) Int. Cl.[7] ..... E21B 33/12

(52) U.S. Cl. ..... 166/386; 166/387; 166/150; 166/151; 166/152; 137/498

(58) Field of Search ..... 106/142, 148, 106/150–152, 373, 381, 386, 387; 137/497, 498, 829

(56) References Cited

U.S. PATENT DOCUMENTS

| | | | | |
|---|---|---|---|---|
| 2,874,785 A | | 2/1959 | Muse | 166/225 |
| 3,794,077 A | * | 2/1974 | Fanshier | |
| 3,872,884 A | * | 3/1975 | Busdiecker et al. | |
| 3,973,587 A | | 8/1976 | Cochran | 137/496 |
| 4,545,431 A | | 10/1985 | Fore | 166/183 |
| 4,646,829 A | | 3/1987 | Barrington et al. | 166/125 |
| 5,029,643 A | | 7/1991 | Winslow et al. | 166/131 |
| 5,727,632 A | * | 3/1998 | Richards | |
| 5,813,456 A | | 9/1998 | Milner et al. | 166/135 |
| 5,819,846 A | | 10/1998 | Bolt, Jr. | 166/123 |
| 5,850,881 A | | 12/1998 | Rodger et al. | 166/327 |

OTHER PUBLICATIONS

International Search Report, dated Jan. 17, 2001 (PCT/GB00/03927).

* cited by examiner

*Primary Examiner*—Roger Schoeppel
(74) *Attorney, Agent, or Firm*—Moser, Patterson & Sheridan, LLP.

(57) ABSTRACT

The present invention generally provides a system and method for selectively sealing a drill string or other tubular member. In one aspect, a sealing member, such as a valve, allows a certain level of flow of drilling fluids and/or other fluids through one or more flow channels when the valve is open. To close the valve, the flow rate is increased so that a backpressure develops and urges the valve to a closed position. The valve can remain in position in the drill string and alternately open and close depending on the flow rate and/or the pressure drop through the valve. The valve also comprises a removable plug disposed in the valve to provide access with, for example, wireline tools to a region below the valve in a wellbore.

27 Claims, 4 Drawing Sheets

FLOW ACTUATED SHUT-OFF VALVE

BACKGROUND OF THE INVENTION

1. Field of the Invention

The present invention relates to oil field tools. More specifically, the invention relates to an apparatus for and a method of using a sealing member, such as a valve, disposed in a wellbore.

2. Background of the Related Art

Oil field wells are drilled typically using a tubular drill string attached to a drill bit to a subterranean producing zone to form a wellbore. Drilling fluid is flowed downhole through the interior of the drill string, through ports, for example, in a drill bit (not shown) to wash away debris at the cutting surfaces, and then upward through an annulus formed between the drill string and a tubular casing that lines the wellbore. The casing is perforated to allow production fluid to flow into the casing and up to the surface of the well, and the drill string is removed from the wellbore.

During drilling, regions of the wellbore are sometimes sealed from other regions. For example, various oilfield equipment, such as motion compensators, periodically need resetting or adjusting in the wellbore. The drill string is plugged and the drilling fluid is raised to a given pressure to actuate or reset the equipment. In other instances, control of the well can be lost due to excessive pressure through the wellbore from subterranean zones. The drill string can become damaged and require repair. The drill string may need temporary plugging below the damage. In other instances, the drill pipe can be temporarily plugged to restrain any flow of production fluid through the drill pipe while zones in the drill string above the plug are tested.

A typical apparatus used to seal between two regions of the drill string is known as a bridge plug and typically includes slip elements and packer elements. The slip elements are used to grip the inside surface of the drill string or other surfaces, thereby preventing the bridge plug from moving up or down in the drill string. The packer elements engage the inside surface of the drill string or the wellbore to provide the requisite seal. The drilling must be stopped to set the retrievable bridge plug, portions of the drilling operation are disassembled, and wireline tools and a bridge plug are inserted into the drill string to an appropriate depth to provide a seal between two zones in the drill string. One type of bridge plug is a permanent bridge plug that can be set in place against a surface, such as an inside surface of a drill string. However, the bridge plug typically is removed by drilling or milling through the plug, which can be costly and time consuming. Another type of plug is a retrievable bridge plug, which typically uses hydraulic fluid to selectively actuate the slip elements and packer elements. The retrievable bridge plug can be removed by releasing pressure on the elements and pulling the bridge plug from the wellbore. Either type of bridge plug needs subsequent removal to provide fluid flow to lower regions or for access with downhole tools. The removal can involve several steps and can be expensive and time consuming. It would be advantageous to be able to be repetitively seal the wellbore or other passageway with an apparatus without necessitating having to drill or mill through the apparatus or to pull the apparatus for removal.

There remains a need for an improved system and method for sealing a drill string that can remain in the wellbore for subsequent use.

SUMMARY OF THE INVENTION

The present invention generally provides a system and method for selectively sealing a drill string or other tubular member. In one aspect, a sealing member, such as a valve, allows a certain level of flow of drilling fluids and/or other fluids through one or more flow channels when the valve is open. To close the valve, the flow rate is increased so that a backpressure develops and urges the valve to a closed position. The valve can remain in position in the drill string and alternately open and close depending on the flow rate and/or the pressure drop through the valve. The valve also comprises a removable plug disposed in the valve to provide access with, for example, wireline tools to a region below the valve in a wellbore.

In one aspect, a system for sealing a wellbore comprises one or more such as tubular members, such as drill pipe, one or more flow actuated shut-off valves coupled to the one or more tubular members, at least one source of fluid coupled to the one or more tubular members, and at least one pressure source coupled to the source of fluid. In another aspect, a flow actuated shut off valve comprises a body, a piston disposed in the body, one or more channels disposed through the piston having an inlet to the piston and an outlet from the piston, and a bias member coupled to the piston. In another aspect, a method of closing an oilfield valve comprises flowing a first fluid through a valve at a first flow rate, flowing the first fluid through the valve at a higher second flow rate, at least partially closing the valve with a force exerted by the second flow rate.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
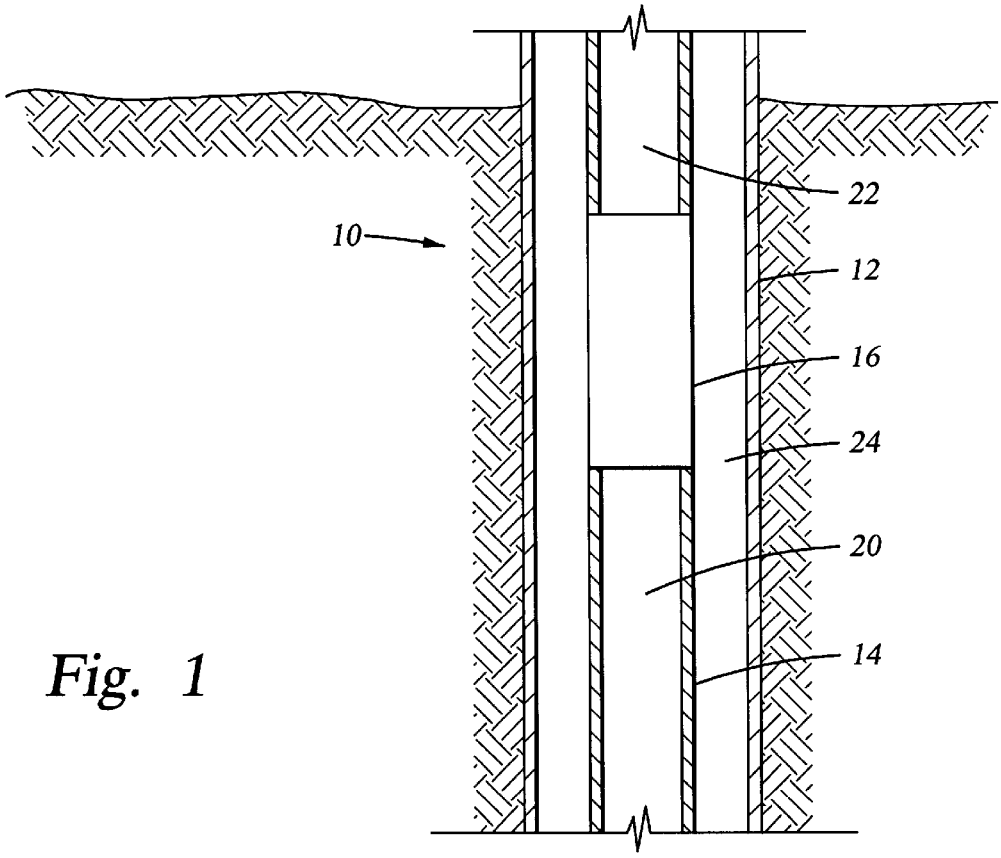
FIG. 1 is a schematic cross sectional view of a valve according to the present invention interposed in a drill string in a wellbore.

FIG. 1 is a schematic cross sectional view of an exemplary sealing member, or a valve 16. The valve 16 is disposed in a drill string 14 in a wellbore 10 that is shown in a vertical orientation. However, other orientations, such as a lateral orientation, are included within the scope of the invention. A casing 12 lines the wellbore 10 and the drill string 14 is disposed therein. The drill string 14 is used to provide rotational output to a tool, such as a drill or mill, and to provide translational movement of tools within the wellbore 10. A valve 16 is threadably inserted between joints 20, 22 of the drill string 14.

Figure 2:
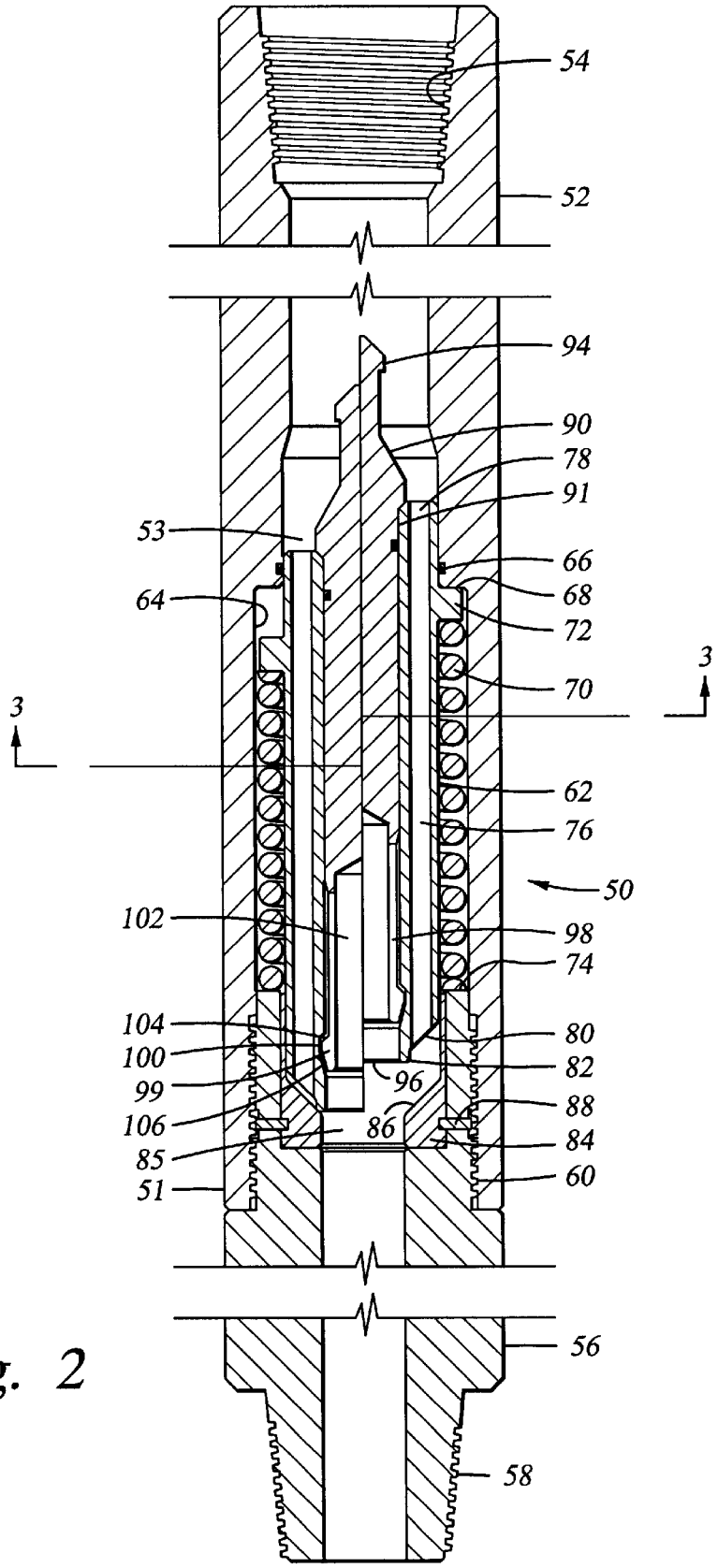
FIG. 2 is a schematic longitudinal cross sectional view of one embodiment of a valve.

FIG. 2 is a schematic longitudinal cross sectional view of one embodiment of a valve 50 in an open (right half of the figure) position and a closed (left half of the figure) position. In general, the valve 50 includes an outer body 51 having an upper portion 52 of the body and a lower portion 56 of the body, a piston 62 slidably disposed in a cavity 53 formed between the upper portion and lower portion, and a replaceable plug 90 disposed in the piston. The upper portion 52 of the body includes one end with standard API female threads 54 and the lower portion 56 of the body includes one end with standard API male threads 58 to mate with the corresponding joints of the drill string on each end. The upper portion 52 of the body and lower portion 56 of the body are joined together at a threaded joint 60 and define an inner cavity 53. The inner cavity includes an annular recess 64 defined between a shoulder 68 in the upper portion 52 of the body and an upper end 74 of the lower portion 56 of the body. The lower portion 56 of the body includes an annular seat 84 having a tapered surface 86. The seat defines a channel 85 through which fluids pass through the valve to other portions of the drill string. The seat 84 is coupled to the lower portion 56 of the body by one or more connectors 88, such as a pin or a bolt. Alternatively, the seat can be formed integral with the lower portion 56 of the body.

The piston 62 is preferably a cylindrical member having an annular flange 72 that is slidably disposed in the recess 64. The piston also includes a plurality of longitudinal channels 76 that are disposed therethrough. The channels have a first end 78 that preferably is an inlet for fluid flowing through the drill string and a second end 80 that preferably is an outlet for the fluid. The size, quantity and shape of the channels 76 can be chosen to allow a certain amount of fluid flow while achieving a certain amount of pressure drop. The surface of the piston adjacent the second end 80 of the channels is preferably tapered between the outer perimeter and an annular protrusion 82 that forms a sealing surface on the piston that engages the seat 84 of the lower portion 56 of the body. The piston 62 also includes an inner channel 91 disposed through the piston and generally aligned with the longitudinal axis of the valve for receipt of the removable plug 90. An inner annular recess 100 is formed in a lower end of the inner channel 91 of the piston 62 to assist in securing the removable plug in the piston. A seal 66, such as an O-ring, is disposed between the outer perimeter of the piston 62 and the inner perimeter of the upper portion 52 of the body.

The removable plug 90 preferably includes a cylindrical body member having a first end 94 shaped to engage a typical wireline fishing tool (not shown) for retrieval and placement in the piston 62. A second end 96 of the plug 90 has one or more flexible fingers 98 that can engage an annular recess 100 in the piston 62. The fingers include one or more locking members 99 that may be integral to the fingers and have tapered surfaces, as shown, or may be separate members, such as a C-ring or O-ring, that is coupled to the fingers to engage the corresponding annular recess 100 in the piston and retain the plug with the piston until removal. A counterbore 102 is defined between the fingers to allow the fingers to flex inwardly as the plug is inserted or removed and reinserted into the piston 62. Preferably, the locking members 99 are tapered at surfaces 104, 106 to correspond to the tapered surfaces of the recess 100 of the piston 62. This configuration allows to allow easy removal and placement of the plug into the piston.

A bias member 70 is disposed in the recess 64 around the piston 62. The bias member can be a spring, such as a coil spring, an elastomeric member, a solenoid operated piston, or other biasing member which could apply a longitudinal force to the piston. The bias member 70 engages the piston 62 at the annular flange 72 on one end and engages an end 74 of the lower portion 56 of the body on the other end. The bias member 70 biases the piston 72 in an open position toward the shoulder 68 of the recess 64.

Figure 3:
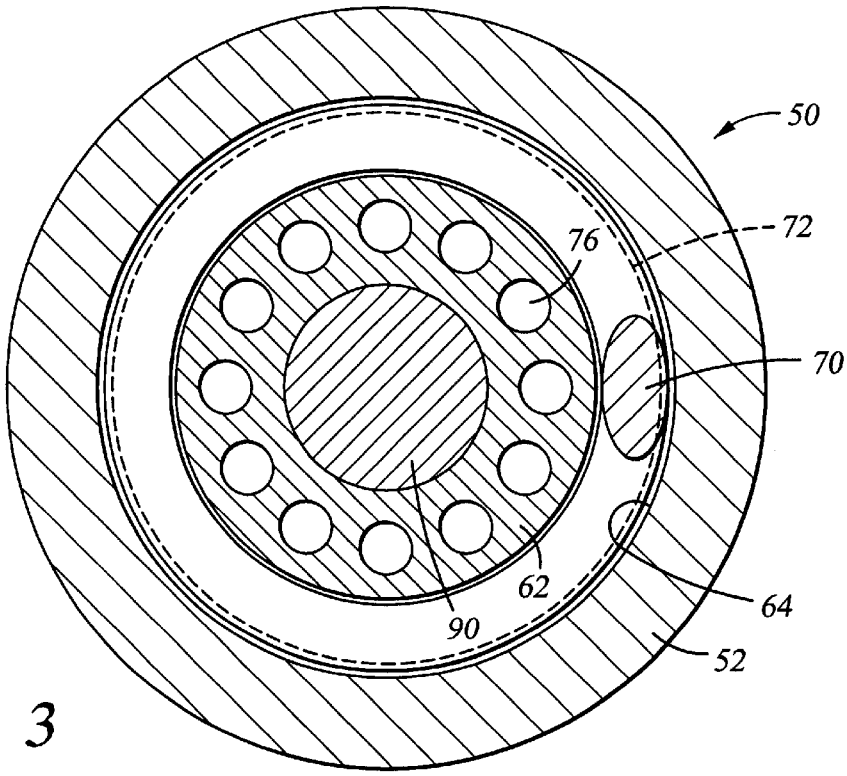
FIG. 3 is a schematic transverse cross sectional view of the valve shown in FIG. 2.

FIG. 3 is a transverse cross sectional view of the valve 50 along line 3—3 in FIG. 2. The piston 62 is disposed in the cavity 53 within the upper portion 52 of the body and lower portion of the body (not shown) and the plug 90 is disposed in the piston. The annular flange 72 is disposed in the recess 64. The bias member 70 circumferentially engages the annular flange 72. The seal 66 is disposed between the piston 62 and the perimeter of the upper portion 52 of the body. Twelve channels 76 are disposed around the piston 62, although the size, quantity and shape can vary, depending on the desired operating conditions of the valve.

Figure 4:
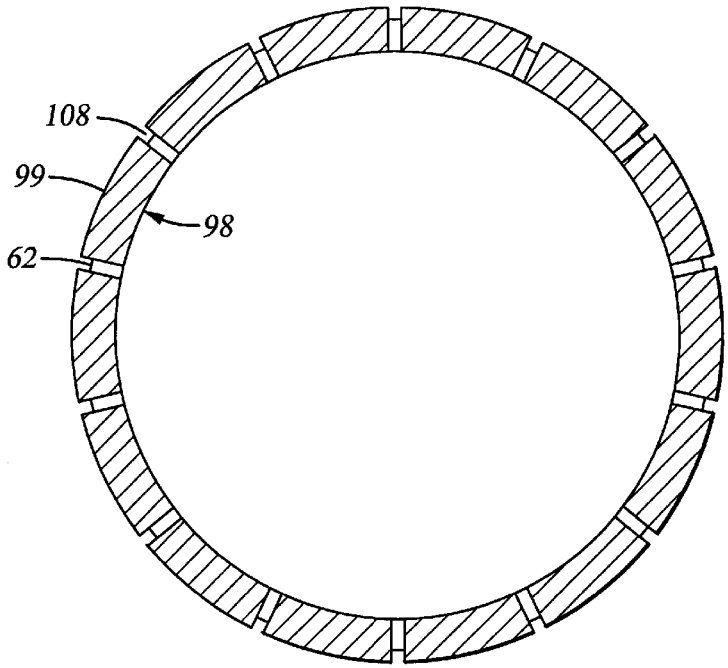
FIG. 4 is a schematic transverse cross sectional view of the plug shown in FIG. 2.

FIG. 4 is a transverse cross sectional view of the plug 90 on the distal end illustrating the fingers 98. Preferably, a plurality of fingers 98 are disposed circumferentially about the perimeter of the plug. The fingers are sized and adapted to flex as the plug is removed and reinserted into the piston 62 (shown in FIG. 2). The fingers 98 define a space 108 therebetween to enable independent flexing of the fingers.

In operation, the valve is open at selected flow rates. The drilling fluid passes through the channels 76, past a seat 84, and through an channel 85 down to, for example, a drilling bit to wash debris away from the bit and up an annulus 24 between the drill string 14 and the casing 12 (shown in FIG. 1). The fluid flow rate creates a pressure drop from the first end 78 of the channels 76 to the second end 80 of the channels and results in a force that attempts to urge the piston 62 downward toward the seat 84. However, the bias member 70 exerts a counterforce that maintains the piston 62 in an upward position. To close the valve, the fluid flow rate is increased to a level that results in a greater force than the bias member 70 exerts on the piston 62 and the valve begins to close. As merely one example, for a 7.5 inch outside diameter valve, the channels 76 can be sized to create a closing pressure drop of about 140 pounds per square inch ("psi") with a flow rate of 700 gallons per minute ("gpm") with 16.0 pounds per gallon (lb./gal.) drilling fluid ("mud weight"). It is believed that the same channels would produce about a 140 psi pressure drop with a flow rate of about 925 gpm with 9.0 lb./gal. mud weight. The bias member 70 can be changed to another bias member, the distance between the flange 72 and the end 74 of the lower portion can be altered or other adjustments made to vary the force required to close the valve. The piston moves longitudinally down in the annular recess 64 with the increased force exerted by the fluid and the annular protrusion 82 seals against the seat 84 to stop the flow. Continued flow into the drill string 14 increases the pressure in the drill string above the valve 50 for testing or other purposes. Releasing or reducing the pressure allows the valve to reset to an open position when the bias member 70 pushes the piston 62 back up in the cavity 53 and fluid flow through the valve can be continued. The valve can be open and closed repetitively in like manner.

To gain access through the valve 50, the plug 90 can be removed with conventional wireline tools by engaging the first end 94 of the plug 90. The fingers 98 flex inward as the plug 90 is pulled away from the piston and disengage the recess 100 to slide out of the inner channel 91 of the piston 62. The plug can be reinserted in like manner.

Figure 5:
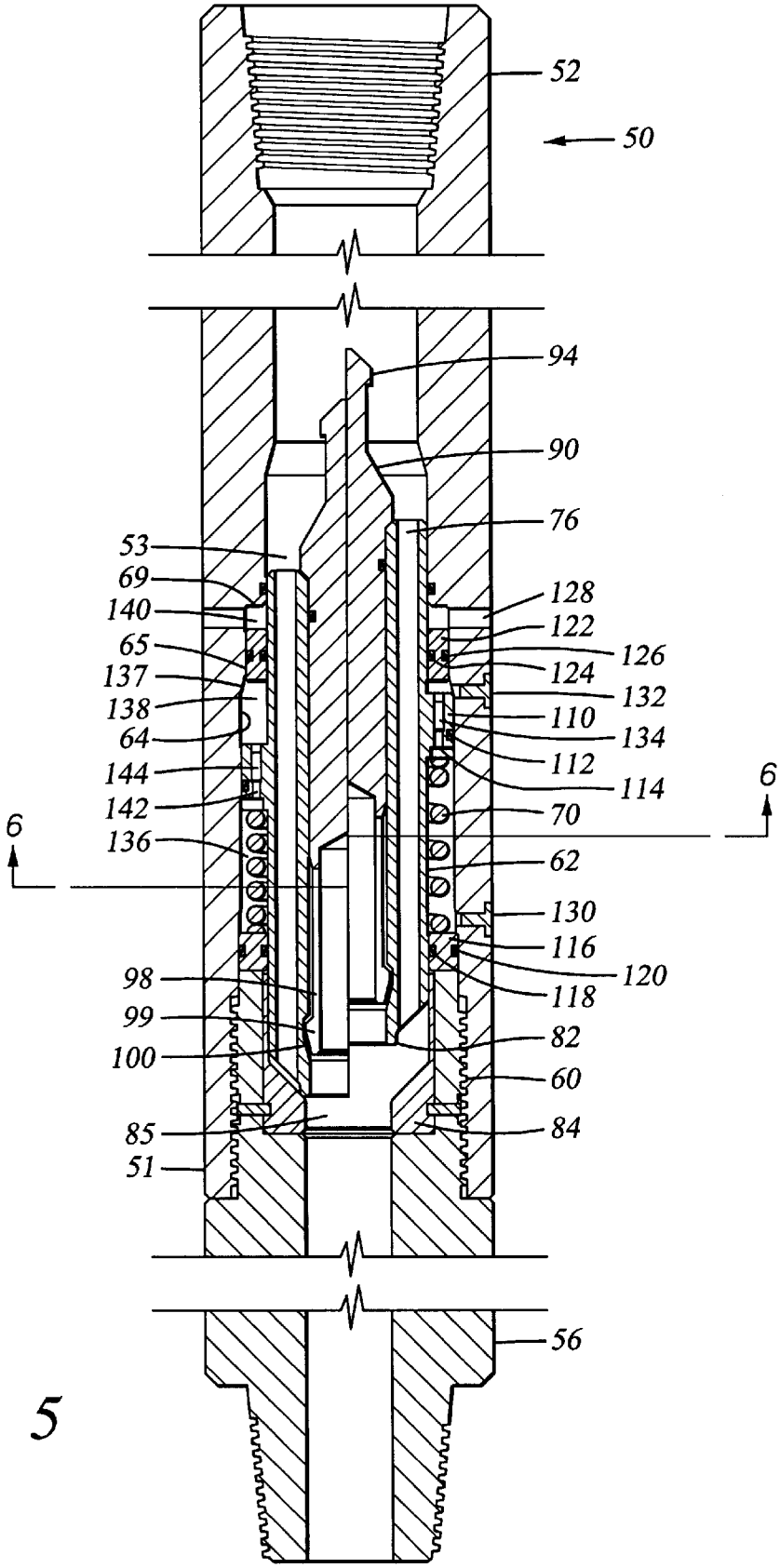
FIG. 5 is a schematic longitudinal cross sectional view of another embodiment of a valve.

FIG. 5 is a schematic longitudinal cross sectional view of another embodiment of a valve in an open (right half of the figure) position and a closed (left half of the figure) position. Elements similar to the embodiment shown in FIGS. 2—4 are similarly numbered. A valve 50 has a body 51 with an upper portion 52 of the body and a lower portion 56 of the body that are coupled together and define a cavity 53 therebetween. In general, valve members disposed in the cavity 53 include a piston 62 having an annular flange 110, a sealing block 116 adjacent the lower portion 56 of the body, a bias member 70 disposed between the flange 110 and the sealing block 116, a floating piston 122 disposed on the opposite side of the flange 110 from the bias member 70, and a replaceable plug disposed in the piston 62. The cavity 53 includes a recess 64 defined between a shoulder 69 and an upper end of the lower portion 56 of the body. The recess 64 may include one or more shoulders along the length of the recess, such as shoulder 137, that can limit the travel of various members slidably disposed in the cavity 53. Ports 130, 132 are formed through the side wall of the upper portion 52 of the body and are plugged as described below. Port 128 is also formed through the side wall of the upper portion 52 of the body and can remain fluidly coupled between the cavity 53 and a region external to the upper portion 52 of the body. The lower portion 56 of the body includes an annular seat 84.

The piston 62 includes one or more channels 76 formed therethrough. An annular protrusion 82 on the end of the piston 62 is disposed adjacent the seat 84 on the lower portion 56 of the body. The piston 62 includes an annular flange 110 that is slidably disposed in the annular recess 64. A seal 112 is disposed between the outer perimeter of the flange 110 and the perimeter of the cavity 53 to slidably seal the flange 110 in the cavity 53. The flange 110 defines at least one channel 114 and at least one channel 142. A pressure relief valve 134 is mounted in the channel 114 and a check valve 144 is mounted in the channel 142. The pressure relief valve is oriented to relieve pressure from below the flange 110 and the check valve is oriented to allow fluid flow from above the flange to below the flange.

An annular sealing block 116 is disposed below the annular flange 110 and above the lower portion 52 of the body. A seal 118 is disposed along an inner perimeter of the block 116 and seals the inner perimeter with the piston. A seal 120 is disposed along an outer perimeter of the block 116 and seals the outer perimeter with the recess 64. The bias member 70 engages the flange 110 on one end of the bias member and the sealing block 116 on the other end. The floating piston 122 is disposed in an upper portion of the recess 66 above the annular flange 132. A seal 124 is disposed between the inner perimeter of the floating piston 122 and the piston 62. A seal 126 is disposed between the outer perimeter of the floating piston 122 and the recess 64. The annular flange 110, sealing block 116, perimeter of the cavity 53 and outer perimeter of the piston 62 define a first region 136 of the recess 64. The annular flange 110, floating piston 122, perimeter of the cavity 53 and outer perimeter of the piston 62 define an second region 138 of the recess 64. The floating piston 122, shoulder 69, perimeter of the cavity 53 and outer perimeter of the piston 62 define a third region 140 of the recess 64. The port 130, formed through the side wall of the upper portion 52 of the body below the flange 110, is fluidly coupled to the first region 136. The port 132, formed through the side wall of the upper portion 52 of the body above the flange 110, is fluidly coupled to the second region 138. The third port 128, formed through the side wall of the upper portion 52 of the body above the floating piston 122, is fluidly coupled to the third region 140. Preferably, the first region 136 and second region 138 are filled with fluid, such as hydraulic fluid and the ports 132, 134 are sealed.

A plug 90 is sealably disposed at least partially within the piston 62. The plug 90 has a first end 94 preferably shaped to engage a conventional wireline tool to effect removal and placement of the plug. A second end 96 of the plug 90 has one or more fingers 98 with one or more locking members that engage an annular recess 100 in the piston 62.

Figure 6:
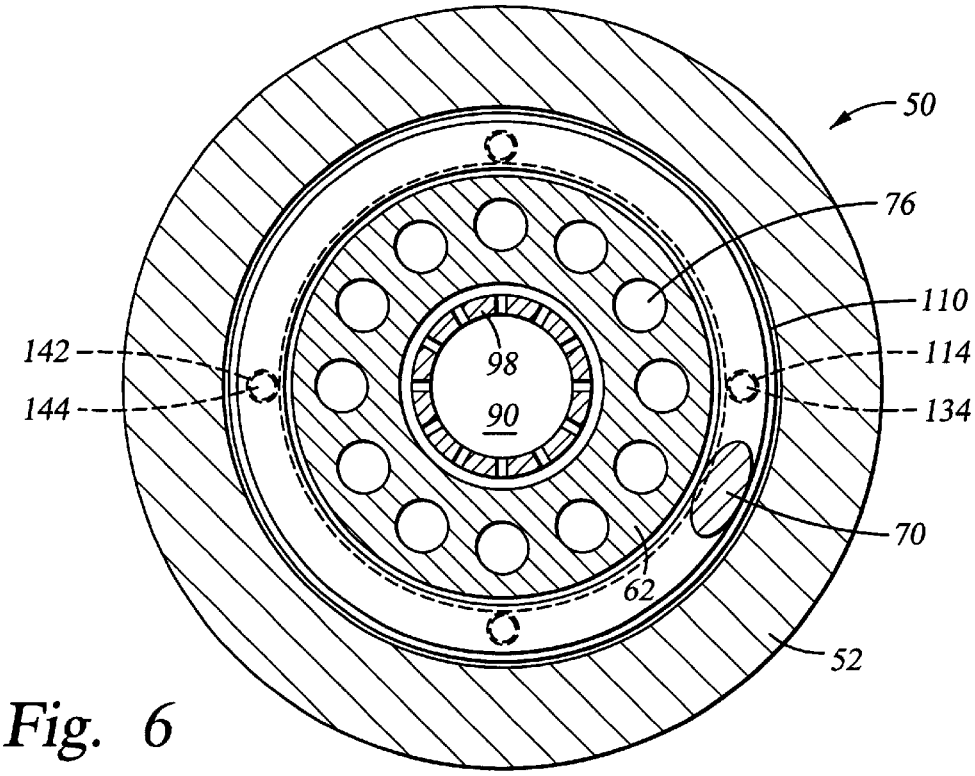
FIG. 6 is a schematic transverse cross sectional view of the valve shown in FIG. 5.

FIG. 6 is a transverse cross sectional view of the valve 50 along line 6—6 in FIG. 5. The piston 62 is disposed between the walls of the upper portion 52 and the plug 90 is disposed in the piston. The plug 90 is coupled to the piston 62 with fingers 98 disposed against an inner perimeter of the piston. A plurality of channels 76 are formed through the length of the piston 62 and allow fluid to flow through the valve 50. An annular flange 110 of the piston 62 is sealably and slidably engaged with an inner perimeter of the upper portion 52 of the body. A bias member (not shown), such as a coil spring, engages the flange 110 to bias the piston. One or more pressure relief valves 134 are disposed in the channels 114 in the piston 62, such as in the flange 110. One or more check valves 144 are disposed in the channels 142 in the piston 62.

In operation, drilling fluid is flowed through the channels 76 downhole to a drilling bit, mill, or other tool to wash the debris out and up through an annulus 24 between the drill string 14 and the casing 12, shown in FIG. 1 when the valve is open. The fluid flow rate through the valve creates a pressure drop from the first end 78 of the channels 76 to the second end 80 of the channels and results in a force that attempts to press the piston 62 downward toward the seat 84. However, fluid sealably disposed in the first region 136 prevents the piston 62 from moving downward. Also, the bias member 70 exerts a counterforce that assists in maintaining the piston 62 in an upward position.

To close the valve 50, the fluid flow rate through the channels 76 is increased to exert a greater force on the piston 62, which attempts to compress the fluid in the first region 136. The relief valve opens when a set relief pressure on the pressure relief valve 134 is exceeded, and the fluid in the first region 136 flows through the pressure relief valve 134 and into the second region 138. The bias member 70 is compressed by the greater force from the increased flow rate of the fluid flowing through the channels 114 and the valve closes. The annular protrusion 82 on the piston 62 engages and seals against the seat 84.

To open the valve 50 again, the fluid flow rate through the channels 76 is reduced and thus, the force created by the fluid on the piston 62 is reduced. The bias member 70 exerts a greater force on the flange 110 than the counterforce produced by pressure of the reduced fluid flow rate and moves the piston 62 in an upward direction in the recess 64. The pressure relief valve 134 can again close if the pressure is sufficiently low. Fluid in the second region 138 flows one way through the check valve 144 back into the first region 136.

The pressure in the second region 138 is balanced with pressure in the wellbore by drilling fluid or other fluid passing through the port 128 into and out of the third region 140. The floating piston 122 moves longitudinally in the recess 64 until the wellbore pressure exerted through the port 128 and into the third region 140 is balanced with the fluid pressure in the second region 138. By balancing the pressure, a more uniform flow rate through the channels 76 before the valve closes can be obtained under varying wellbore pressures and temperatures. The floating piston 122 also allows thermal expansion of the fluid in the second region 138 and/or the first region 136.

The force required to close the valve, and therefore the fluid flow through the channels 76, can be varied by adjusting several aspects of the valve 50. For example, the pressure at which the relief valve 134 opens can be adjusted by either substitution of the relief valve or by changing the pressure of an adjustable relief valve. The bias member 70 can be substituted for a different bias member. The bias member can be extended or compressed by, for example, elongating or shortening the recess 64. Another example of varying the force is elongating or shortening the annular flange on the piston. Each of the described alterations and others can change the force at which the valve closes. Furthermore, the force can be linear or non-linear. For example, a linear force could include a bias member that compresses at a fixed rate of force per unit length. A non-linear force could include a bias member having a variable rate of force per unit length. Different rates could, for instance, allow the valve to throttle the flow in a partially closed position at certain rates of flow.

Aspects of the invention have been described in reference to a drill string. The invention is not limited to a drill string, but can be used in various applications related to sealing members with flow-through fluids and piping, particularly in oil field technology. Additionally, references to direction, such as "up", "down", "above" and "below", are for reference to the flow direction and position of elements in the description and claims and are intended to be only exemplary and not limiting, and may be varied depending on the desired direction of flow and the relative locations of the elements.

While the foregoing is directed to the preferred embodiment of the present invention, other and further embodiments of the invention may be devised without departing from the basic scope thereof, and the scope thereof is determined by the claims that follow.

What is claimed is:

1. A system for selective sealing in a wellbore, comprising:

a) one or more tubular members;

b) one or more flow actuated sealing members coupled to the one or more tubular members, the sealing member having a removable plug;

c) a first source of fluid coupled to the one or more tubular members; and d) at least one pressure source coupled to the fluid.

2. The system of claim 1, wherein the flow actuated sealing member further comprises:

a) a body;

b) an annular piston disposed in the body, wherein the removable plug is disposed in the annular piston with a mechanical connection therebetween;

c) one or more channels disposed through the annular piston having an inlet and an outlet; and d) a bias member coupled to the piston.

3. The system of claim 2, wherein the mechanical connection includes one or more fingers formed on the removable plug having one or more locking members that engage the piston.

4. The system of claim 2, further comprising a seat disposed in the body and a mating sealing surface on the piston.

5. The system of claim 4, wherein the channels are sized to enable a force from a pressure drop at a given flow rate through the channels to overcome an opposing force from the bias member.

6. The system of claim 1, wherein the channels are generally disposed in alignment with an axis of the bias member.

7. The system of claim 1, wherein the sealing member comprises a pressure relief valve fluidly coupled to a first pressure region disposed downstream in the valve from the first source of fluid.

8. The system of claim 7, wherein the bias member is adapted to bias the piston in an upward position and the pressure relief valve is adapted to relieve pressure from the first pressure region.

9. The system of claim 7, further comprising a floating piston disposed on one side of the pressure relief valve in a region of the sealing member having a port open to a pressure source outside the sealing member.

10. A flow actuated sealing member for selectively sealing a tubular, comprising:

a) a body;

b) an annular piston movably disposed in the body;

c) one or more channels disposed through the piston having an inlet to the piston and an outlet from the piston;

d) a bias member coupled to the piston; and e) a removable plug disposed in the annular piston having a mechanical connection therebetween.

11. The sealing member of claim 10, wherein the channels are generally disposed in alignment with a longitudinal axis of the bias member.

12. The sealing member of claim 10, further comprising a seat disposed in the body and a mating sealing surface on the piston.

13. The sealing member of claim 12, wherein the channels are sized to enable a force from a pressure drop at a given flow rate through the channels to overcome an opposing force from the bias member.

14. The sealing member of claim 10, wherein the mechanical connection includes one or more fingers formed on the removable plug having one or more locking members that engage the piston.

15. The sealing member of claim 10, wherein the sealing member comprises a pressure relief valve fluidly coupled to a first pressure region disposed downstream in the body.

16. The sealing member of claim 15, wherein the bias member is adapted to bias the piston in an upward position and the pressure relief valve is adapted to relieve pressure from the first pressure region.

17. The sealing member of claim 15, further comprising a floating piston disposed on one side of the pressure relief valve in a region of the sealing member having a port open to a pressure source outside the sealing member.

18. A method of selectively closing a downhole valve, comprising:

a) flowing a first fluid through a valve at a first flow rate, the valve having an annular piston and a removable plug disposed in the annular piston with a mechanical connection therebetween;

b) flowing the first fluid through the valve at a higher second flow rate;

c) at least partially closing the valve with a force created by the second flow rate.

19. The method of claim 18, further comprising pressurizing a tubular member coupled to an upstream side of the valve.

20. The method of claim 18, wherein the valve is biased open with a bias member engaged with a piston in the valve.

21. The method of claim 20, wherein the second flow rate provides a pressure drop through the one or more channels in the piston to create a force that is greater than a bias exerted on the piston.

22. The method of claim 21, wherein at least partially closing the valve comprises pressing the piston downstream with the force created by the second flow rate through the channels.

23. The method of claim 22, further comprising opening a pressure relief valve to allow the piston to move downstream in the valve.

24. The method of claim 23, wherein the valve defines a first region below the pressure relief valve and a second region above the pressure relief valve, the first region having a fluid pressure equal to or greater than a fluid pressure in the second region when the piston is in an upward position in the valve.

25. The method of claim 24, further comprising reducing the second flow rate and allowing the piston to move upstream in the valve.

26. The method of claim 18, further comprising biasing a piston in the valve in an open position with a force exerted on the piston by a bias member and by a second fluid pressed against a closed pressure relief valve.

27. The method of claim 18, further comprising adjusting a closing force on the valve by altering a force exerted on a downstream side of the valve.

* * * * *

UNITED STATES PATENT AND TRADEMARK OFFICE

CERTIFICATE OF CORRECTION

PATENT NO. : 6,349,771 B1
DATED : February 26, 2002
INVENTOR(S) : Luke

It is certified that error appears in the above-identified patent and that said Letters Patent is hereby corrected as shown below:

Column 10,
Line 1, please replace “24” with -- 21 --.

Signed and Sealed this

Third Day of September, 2002

*Attest:*

*Attesting Officer*

JAMES E. ROGAN
*Director of the United States Patent and Trademark Office*